United States Patent [19]

Pankove

[11] B 3,986,065

[45] Oct. 12, 1976

[54] INSULATING NITRIDE COMPOUNDS AS ELECTRON EMITTERS

[75] Inventor: Jacques Isaac Pankove, Princeton, N.J.

[73] Assignee: RCA Corporation, New York, N.Y.

[22] Filed: Oct. 24, 1974

[21] Appl. No.: 517,762

[44] Published under the second Trial Voluntary Protest Program on March 16, 1976 as document No. B 517,762.

[52] U.S. Cl. ..... 313/94; 315/94; 313/346 R

[51] Int. Cl.[2] ..... H01J 39/06; H01J 1/30; H01J 19/24

[58] Field of Search ..... 313/94; 357/30

[56] References Cited

UNITED STATES PATENTS

| | | | |
|---|---|---|---|
| 3,387,161 | 6/1968 | Laar et al. | 313/94 |
| 3,513,316 | 5/1970 | Hirschfeld | 313/94 X |
| 3,631,303 | 12/1971 | Antypas et al. | 313/94 X |
| 3,644,770 | 2/1972 | Bell | 313/94 |

OTHER PUBLICATIONS

Maruska et al., "The Preparation and Properties of Vapor-Deposited Single-Crystalline GaN;" Applied Physics Letters, vol. 15, No. 10, Nov. 15, 1969.

*Primary Examiner*—Robert Segal
*Attorney, Agent, or Firm*—G. H. Bruestle; R. L. Yin

[57] ABSTRACT

A high emission of electrons, as a result of negative electron affinity, has been achieved from an insulating nitride coated with a film of an electropositive work function reducing material.

3 Claims, 4 Drawing Figures

INSULATING NITRIDE COMPOUNDS AS ELECTRON EMITTERS

BACKGROUND TO INVENTION

The present invention relates to an electron emitter, and more particularly to an electron emitter constructed from an insulating nitride compound.

One type of electron emitter or cathode which has been used in electron discharge devices is known as "cold" cathode, in that the cathode does not use heat to generate electrons. Rather, the electrons are induced to leave the bulk of the material into the surrounding vacuum by the effect of negative electron affinity (NEA). NEA results when the potential energy level of the conduction band edge in the bulk is higher than the vacuum level at the surface.

Heretofore, "cold" electron emitters have used semiconducting material doped with acceptors to bring the fermi level close to the valence band, thereby maximizing the potential energy of the conduction band edge. NEA results when the surface of these P type semiconductors is coated with a layer of an electropositive work function reducing material, such as alkali or alkaline earth metals.

SUMMARY OF INVENTION

An electron emitter includes a body of an insulating nitride selected from a group consisting of GaN, AlN, and InN or a mixture thereof. A thin layer of a work function reducing material is deposited on one or more surfaces of the insulating nitride.

DETAILED DESCRIPTION OF THE INVENTION

Figure 1:
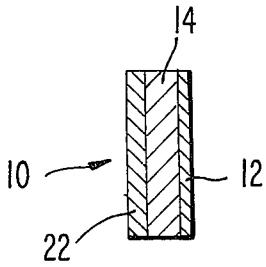
FIG. 1 is a cross-sectional view of an embodiment of the electron emitter of the present invention.

Referring initially to FIG. 1, there is shown an electron emitter, generally designated as 10. The electron emitter 10 comprises a body 14 of a nitride, such as GaN, AlN, InN or a mixture thereof, on a substrate 22. The substrate 22 can be insulating, such as sapphire, or it can be conducting, such as tungsten, molybdenum, tantalum or undoped GaN. The body 14 is doped with an acceptor, such as Zn, Be, Mg, or Li, to render the body 14 insulating. The concentration of this doping material must be greater than about $10^{18}/cm^3$ in the body 14. On at least one surface of the body 14 is deposited a thin layer 12 of a material to reduce the surface work function, such as Cs, Ba, K, or a mixture of Cs and $O_2$. For optimal performance, the thin layer 12 should be about monomolecular in thickness.

The nitride body 14 can be formed on substrate 22 by any conventional means of crystal growth. For example, the method as described in the article entitled "The Preparation and Properties of Vapor-Deposited Single Crystalline GaN" by H. P. Maruska and J. J. Tietjen published in Applied Physics Letters, Volume 15 p. 327 (1969) is well suited for this purpose. Before the thin layer 12 is deposited on body 14, the doped body 14 is cleaned by heating to a temperature of about 800°C for several minutes in ultrahigh vacuum, and then is cooled to room temperature. A gaseous form of the material to reduce the surface work function is introduced and adsorbed on the surface body 14.

Figure 2:
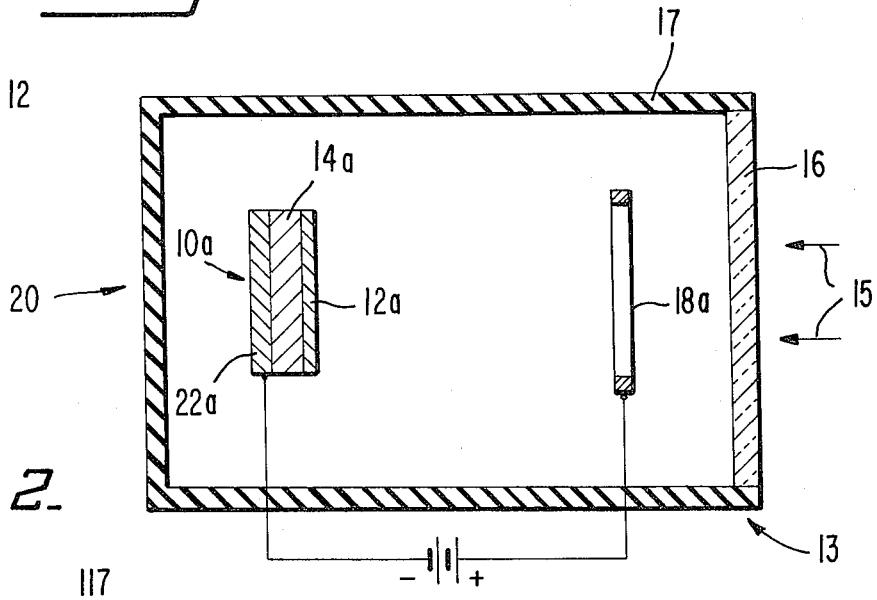
FIG. 2 is a cross-sectional view of a photon detector in which an embodiment of the electron emitter of the present invention is used in the reflective mode.

Referring to FIG. 2, there is shown a photon detector, generally designated as 20, in which an embodiment of the electron emitter of the present invention is used in the reflective mode. The electron emitter **10*a* and an anode 18*a*, constructed in the shape of a ring, are enclosed in a vacuum envelope 13. The envelope 13 comprises an opaque outer insulating shell 17, which may be a suitable ceramic material, and a transparent end plate window 16, which may be quartz or sapphire. The end plate window 16, the anode 18*a*, and the electron emitter 10*a* are linearly spaced such that the anode 18*a* is between the electron emitter 10*a* and the end plate window 16. The electron emitter 10*a* is oriented such that the surface of the thin layer 12*a* faces in the direction of the anode 18*a* and the end plate window 16. An electrode 22*a*, which is opposite the thin layer 12*a*, can be the conducting substrate on which the body 14*a* is grown. A potential difference is applied between the anode 18*a* and the electrode 22*a* by which the anode 18*a* is made positive with respect to the electrode 22*a*. Photons of sufficiently high energy to excite electrons across the energy gap of the body 14*a* of the electron emitter 10*a* are impinged upon that body in the direction as shown by the arrow 15. A plurality of electrons, released as a result of negative electron affinity, are emitted from the body 14*a* through the thin layer 12*a* into the vacuum and toward the anode 18*a***.

Figure 3:
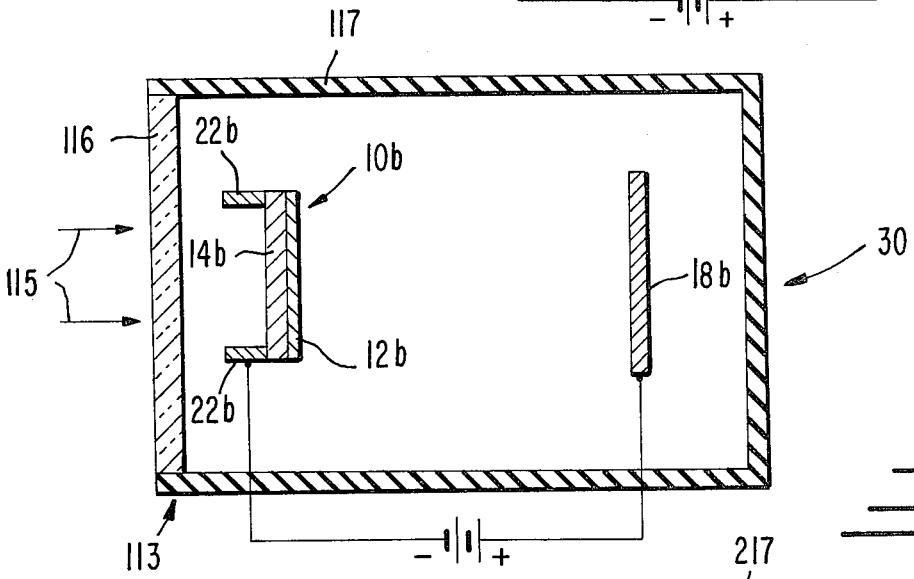
FIG. 3 is a cross-sectional view of a photon detector in which an embodiment of the electron emitter of the present invention is used in the transmission mode.

Referring to FIG. 3, there is shown a photon detector, generally designated as 30, in which an embodiment of the present invention is used in the transmission mode. The electron emitter **10*b* and an anode 18*b* are enclosed in a vacuum envelope 113. The envelope 113 comprises an opaque outer insulating shell 117, which may be a suitable ceramic material, and a transparent end plate window 116, which may be quartz or sapphire. The end plate window 116, the electron emitter 10*b*, and the anode 18*b* are linearly spaced such that the electron emitter 10*b* is between the anode 18*b* and the end plate window 116. The electron emitter 10*b* is oriented such that the surface of the thin layer 12*b* faces in the direction of the anode 18*b*. Electrodes 22*b* are opposite to the thin layer 12*b* and face in the direction of the end plate window 116. The electrodes 22*b* can be made by etching away a portion of the conducting substrate on which the body 14*b* is grown, such that a significant portion of the surface of the body 14*b* is exposed to the incident radiation as shown by the arrow 115. The electrodes 22*b* must also act as a support for the body 14*b*, which in the transmission mode of operation is extremely thin (on the order of one micrometer). A potential difference is applied between the anode 18*b* and the electrodes 22*b* by which the anode 18*b* is positive with respect to the electrodes 22*b*. Photons of sufficiently high energy to excite electrons across the energy gap of the body 14*b* of the electron emitter 10*b* are impinged upon that body in the direction as shown by the arrow 115. A plurality of electrons released as a result of negative electron affinity, are emitted from the body 14***b* through the thin layer 12*b* into the vacuum and toward the anode 18*b*.

Figure 4:
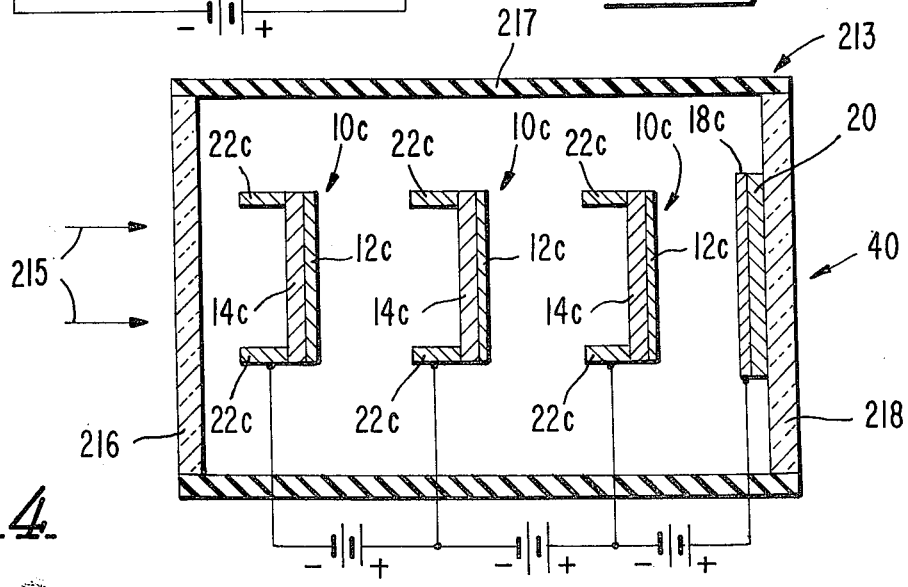
FIG. 4 is a cross-sectional view of a multiplying image converter in which an embodiment of the electron emitter of the present invention is used.

Referring to FIG. 4, there is shown a multiplying image converter generally designated as 40. One or more electron emitters 10*c*, of the same structure as the electron emitter 10*b* in FIG. 3 and described above, are enclosed in a vacuum envelope 213. The envelope 213 comprises a cylindrical opaque outer insulating shell 217, which may be a ceramic material, and a transparent end plate window 218, which may be suitable glass and a transparent end plate window 216 which may be quartz or sapphire. Attached to the transparent end plate window 218 is a phosphor layer 20. An electron-permeable anode 18*c*, such as a thin layer of aluminum, is attached to the phosphor layer 20. The electron emitters 10*c* and the end plate windows 216 and 218 are linearly spaced such that the thin layer 12*c* of each electron emitter 10*c* faces in the direction of the anode 18*c*. A potential difference is applied between the anode 18*c* and the electrode 22*c* of each electron emitter 10*c* such that the electrode 22*c* of each electron emitter 10*c* is made more negative as it is placed further from the anode 18*c*. The electron emitter 10*c* which is furthest away from the anode 18*c* is called the photocathode.

In the mode of operation, photons of sufficiently high energy, to excite electrons across the energy gap of the body 14*c* of the photocathode are impinged upon that body in the direction as shown by the arrow 215. A plurality of electrons, released as a result of negative electron affinity, travel in the direction of the next electron emitter or dynode which is biased positively with respect to the photocathode. These electrons produce many secondary electrons in that dynode. The secondary electrons, whose number exceeds the number of incident electrons by a factor of V/10, where V is the voltage between the photocathode and the dynode, can exit body 14*c* of that dynode at the NEA surface 12*c*. The multiplying effect of more electrons released than impinged and the final conversion of these electrons to photons by the phosphor layer 20 is the characteristic of the multiplying image converter

40. Advantages of this type of multiplying image converter include less dispersion, lower delay time, and more compact device. Although the multiplying image converter 40, as shown in FIG. 4, has only three electron emitters 10*c*, it is obvious that the number of electron emitters will be limited only by the size and shape of the vacuum envelope 213.

To accurately focus the path of the electrons as they travel from one electron emitter 10*c* to another, the multiplying image converter 40 can be placed in a magnetic field such that the lines of the field are perpendicular to the end plate windows 216 and 218. Alternatively, electrostatic lens, placed in the vacuum envelope 213 between successive electron emitters 10*c*, can also be used.

Moreover, the body 14*c* of the photocathode can be a suitably selected insulating nitride such that only incident photons of sufficient high energy (e.g. ultraviolet radiation) will cause an emission of electrons in that body. In this mode of operation the multiplying image converter 40 has become a detector for high energy photons without the need to shield the detector from the lower energy photons. In addition, body 14*c* of the photocathode can also be a suitable selected material such that the photocathode will emit electrons in response to photons of lower energy.

What is claimed is:

1. An electron emitter comprising:

a body of an electrically insulating nitride selected from a group consisting of GaN, AlN, InN, and mixtures thereof, said body being rendered electrically insulating by doping with a material selected from a group consisting of Be, Zn, Mg, and Li to a concentration greater than about $10^{18}/cm^3$; and a layer of work function reducing material, on at least one surface of said body.

2. An electron emitter in accordance with claim 1 in which said layer is a material selected from a group consisting of Cs, Ba, K, and mixture of Cs and $O_2$.

3. An electron emitter in accordance with claim 2 in which said layer is about monomolecular in thickness.

* * * * *

UNITED STATES PATENT OFFICE
CERTIFICATE OF CORRECTION

PATENT NO. : 3,986,065

DATED : October 12, 1976

INVENTOR(S) : Jacques Isaac Pankove

It is certified that error appears in the above-identified patent and that said Letters Patent are hereby corrected as shown below:

Column 3, line 36, before "V/10" --about-- should be inserted.

Signed and Sealed this

Fourth Day of January 1977

[SEAL]

*Attest:*

RUTH C. MASON
*Attesting Officer*

C. MARSHALL DANN
*Commissioner of Patents and Trademarks*